United States Patent [19]

Whitaker, Jr.

[11] Patent Number: 4,843,967

[45] Date of Patent: Jul. 4, 1989

[54] COMPACTION TAMPER

[75] Inventor: John B. Whitaker, Jr., Wetumpka, Ala.

[73] Assignee: Kershaw Manufacturing Company, Ind., Montgomery, Ala.

[21] Appl. No.: 261,255

[22] Filed: Oct. 24, 1988

[51] Int. Cl.[4] ..... E01B 27/12; E01B 27/20

[52] U.S. Cl. ..... 104/12

[58] Field of Search ..... 104/2, 10, 11, 12

[56] References Cited

U.S. PATENT DOCUMENTS 3,828,679 8/1974 Eisenmann et al. ..... 104/12
4,497,256 2/1985 Hansmann et al. ..... 104/12 X

FOREIGN PATENT DOCUMENTS 1807156 9/1970 Fed. Rep. of Germany ..... 104/12
1143799 10/1957 France ..... 104/10
994905 6/1985 United Kingdom ..... 104/12

*Primary Examiner*—Robert B. Reeves
*Assistant Examiner*—Gary C. Hoge
*Attorney, Agent, or Firm*—Jennings, Carter, Thompson & Veal

[57] ABSTRACT

A combined tamper and compaction apparatus for use on a railroad track leveling machine utilizes hollow tamping tools which are inserted in loose ballast on either side of a cross tie. The tamping tools are vibrated to "fluidize" the ballast and plungers mounted within the tamping tools force the ballast therein downwardly and outwardly beneath the ties. Thereafter the tamping tools with plungers extended are raised and lowered to compact the ballast.

16 Claims, 3 Drawing Sheets

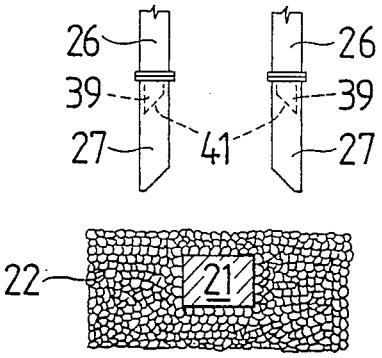
FIG. 6
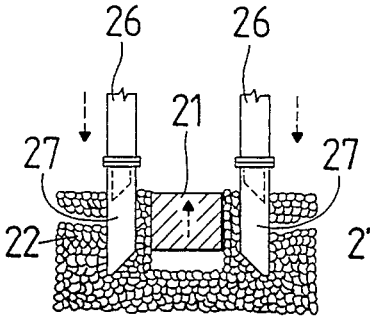
FIG. 7
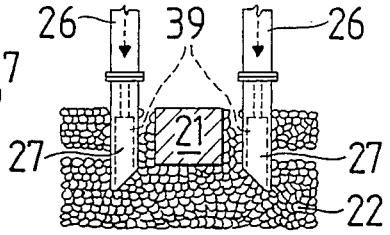
FIG. 8
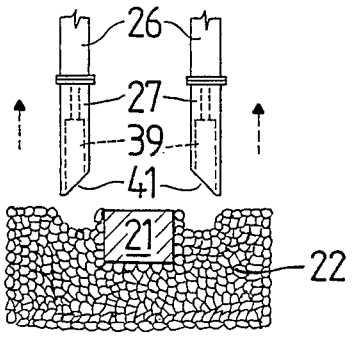
FIG. 9
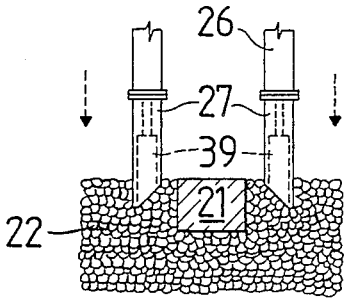
FIG. 10
FIG. 5
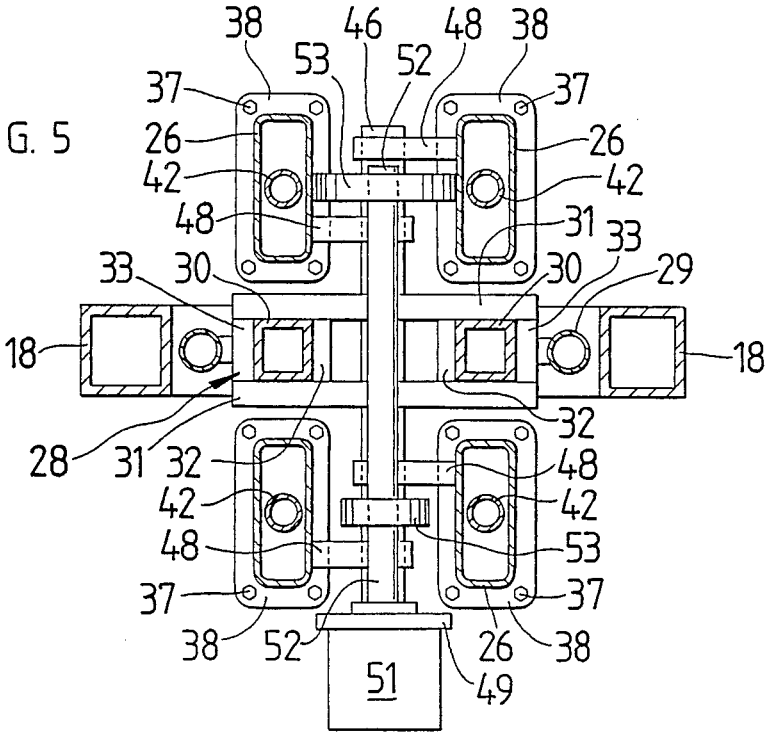

COMPACTION TAMPER

FIELD OF THE INVENTION

The present invention relates to railroad maintenance equipment and more particularly to equipment used for tamping and compacting ballast beneath railroad sleepers or cross ties.

BACKGROUND OF THE INVENTION

Compaction of railroad ballast is well known. Compaction causes the irregularly-shaped pieces of ballast to vibrate into position against each other and the cross ties. Thus the ballast fits more tightly than when simply unloaded onto the track by gravity flow. Tamping seeks to compact the ballast beneath the sleepers to provide a more stable track and reduce settling of the track due to traffic.

Conventional tampers have utilized pivotally mounted tamping tools which attempt to squeeze the ballast inwardly beneath the ties as the tools pivot about a horizontal axis. It is clear from elementary geometry that such devices can thus only provide such compaction as may be accomplished in the arc swept by the tools, thus very little tamping may actually occur beneath the cross tie.

SUMMARY OF THE INVENTION

It is the object of the present invention to combine the function of a tamping machine and a compacting machine in one machine.

As a corollary to the foregoing object it is the object of the present invention to provide optimum consolidation of ballast beneath the cross ties.

Yet another object is to reduce the cost of maintaining the track by consolidating the compacting and tamping operation.

These and other objects of my invention are accomplished through a combination of features which direct the tamping forces inwardly beneath the ties to a greater degree than possible using pivoting tamping tools. My invention utilizes the fluid-like character of the ballast as it is vibrated in the conventional tamping procedure to force additional ballast into the region beneath the ballast. That is to say, conventional tamping tools apply primarily lateral pressure to ballast material located at a depth beneath the tie. My apparatus applies lateral pressure and also forces superadjacent ballast material downward to maintain the consolidation of the ballast.

To accomplish this, my apparatus is equipped with hollow, vibrating tubes that are urged into newly placed ballast adjacent the cross ties. A portion of the ballast is captured within the vibrating tubes which also have a vertically movable ram mounted therewithin. As an associated track-raising apparatus lifts the track, the rams descend urging the trapped ballast downwardly and laterally thereby compressing the trapped ballast and the ballast beneath the ties.

BRIEF DESCRIPTION OF THE DRAWINGS

Apparatus embodying features of my invention are depicted in the accompanying drawings which form a portion of this disclosure and wherein:

FIG. 5 is a sectional view taken along line 5—5 of FIG. 2; and

FIGS. 6–10 depict a cycle of operation of my machine.

DESCRIPTION OF A PREFERRED EMBODIMENT

Figure 1:
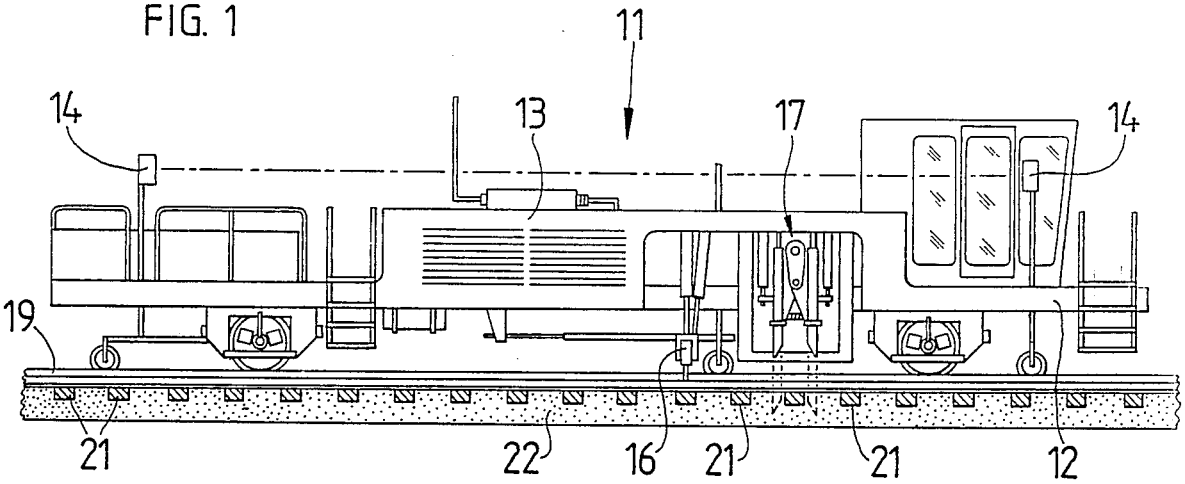
FIG. 1 is a side elevational view of a railroad maintenance machine which employs my invention.

Referring to the figures for a clearer understanding of the invention, it may be seen that the present invention is most readily used in conjunction with other track maintenance equipment. Referring to FIG. 1, a track maintenance apparatus on which my apparatus is used is depicted generally at numeral 11. The track maintenance apparatus 11 includes a chassis 12, power unit 13, light beam leveling measurement device 14, and a rail lifting device 16. Each of these are known in the art and cooperate with conventional tamping tools in a well known manner.

My apparatus is shown generally at 17 and includes a frame 18 supported on the chassis 12 and suspended above the underlying railroad track 19 which is supported on cross ties 21 or sleepers and a bed of ballast 22. The frame 18 serves as support for a tamping assembly 24. The tamping assembly 24 includes a plurality of hollow tubular members 26, each of which terminate in a wedge-shaped replaceable foot 27, and is carried by a tamper mount 28 which is movable vertically within frame 18 under the control of lift cylinder 29 connected on either side of the tamper mount 28 and to the chassis 12. The tamper mount 28 moves vertically along a pair of parallel guide columns 30 mounted between the frame 18 and the chassis 12, and serves to space the tubular members 26 apart. The guide columns 30 are centered on the rail 19 and serve as a pair of male slider boxes for the tamper mount 28. The tamper mount 28 may include a pair of parallel side plates 31 which run parallel to the rails 19. A pair of inner slider plates 32 and a pair of outer slider plates 33 are affixed to the side plates 31 at right angles. Each inner slider plate 32 cooperates with an outer slider plate 33 to form a female slider box about one of the guide columns 30. An ear 34 extends laterally outward from each of the outer slider plates 33 to provide mounts for attaching the lift cylinders 29 to the tamper mount 28. A lift cylinder plunger 29' extends through an aperture in each ear 34 and is affixed thereto by a pair of nuts 36. The tamper mount 38 supports the tamper heads 26 in spaced relation such that a cross tie may fit between the tamper heads 26 and the replaceable feet 27.

Each tamper head 26 and its associated replaceable foot are connected by nuts and bolts 37 passing through a set of mating flanges 38. The lower end of each tamper foot 27 is wedge-shaped in that the tamper foot 26 is essentially a rectangular tube, the outermost wall of which is longer vertically than the innermost wall with the connecting walls having a trapezoidal shape. Thus each tamper foot 27 has a lower extremity which opens downwardly and inwardly toward adjacent cross ties. Slidably mounted for movement within each tamper head 26 and foot 27 is a plunger 39 which has a lower face 41 which slopes upwardly and inwardly, thereby cooperating with the lower extremity of the replaceable foot 27 such that when the plunger 39 is at its lowermost position within the shoe, the face 41 is parallel to the lower edges of the foot 27. The plunger 39 is moved vertically by one or more hydraulic cylinders 42 conventionally connected between the top of the plunger 39 and the upper portion of the tubular members 26. Each of the plungers 39 is pivotally connected to a hydraulic cylinder 42 by a pin 43 inserted through a lug 44. The cylinder 42 can retract the plungers 39 a substantial distance to within the tubular member 26 and extend the plunger 44 co-extensively with the foot 27.

Figure 4:
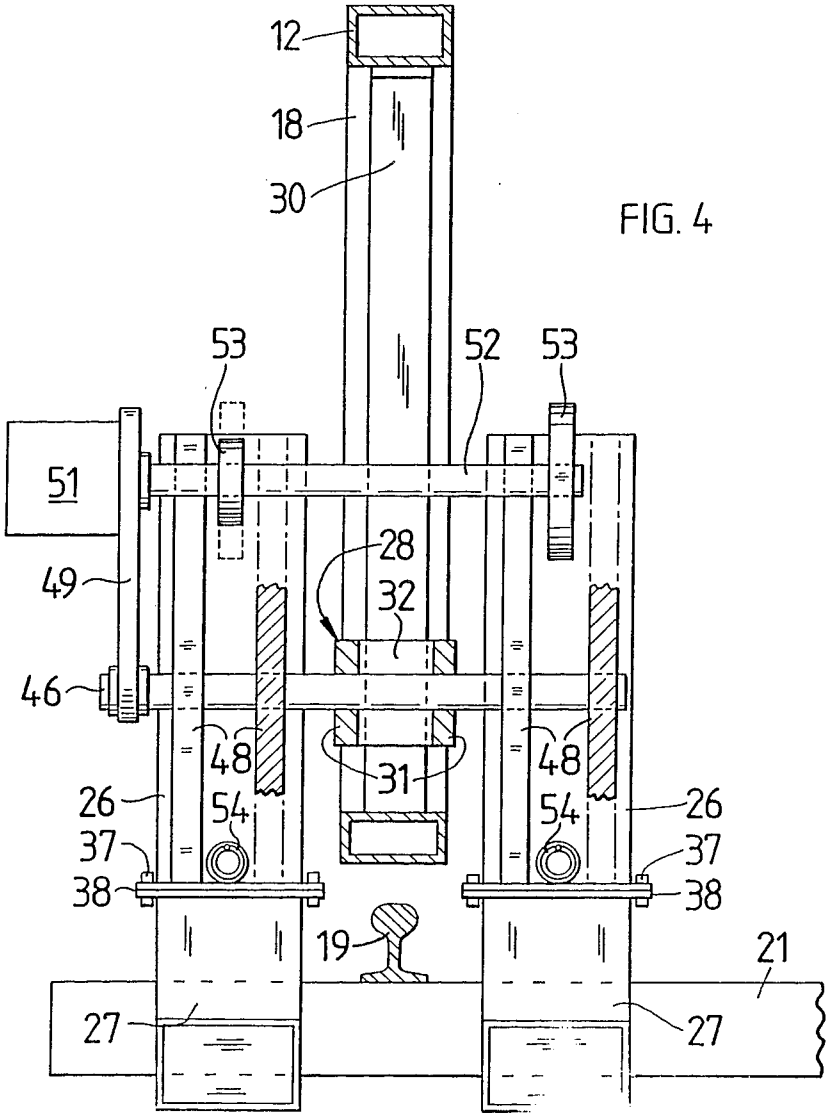
FIG. 4 is a sectional view taken along line 4—4 of FIG. 2.

As may be seen in FIGS. 4 and 5, each tamper mount 28 supports four tubular members 26, with two of the tubular members 26 located on each side of the cross ties 21 such that the rail 19 passes between the two associated pairs of tubular members. Thus an inboard and outboard pair of tubular members 26 and feet 27 are defined relative to the rail 19. A pivot shaft 46, oriented parallel to the ties 21, is rigidly affixed in the side plates 31 of the tamper mount 28 and moves upwardly and downwardly therewith. Each tubular member 26 is also affixed to and supported by the pivot shaft 46 by means of a pivot arm 48. Each pivot arm 48 is affixed directly to the inner face of a tubular member 26 and extends perpendicularly outward therefrom. The pivot arms 48 and the attached tubular members 26 move about the pivot shaft 46 upon activation of the vibrating system described below.

The end of the pivot shaft 46 which projects outwardly over the track shoulder serves as a point of attachment for a motor mount plate 49. The motor mount plate 49 extends vertically upward from the pivot shaft 46 and mounts a hydraulic motor 51. A drive shaft 52 emanates from the motor 51, passes through the motor mount plates 49 and extends parallel to the pivot shaft 46. Note that the drive shaft 52 is positioned vertically above the pivot shaft 46 and bisects the distance between the upper ends of the associated tubular members 26 comprising each inboard and outboard pair. A pair of elliptical camming lobes 53 are affixed on the drive shaft 52 and act directly on the upper ends of the tubular members 26. The pivot arms 48 on each pair of tubular members pass fore and aft of the camming lobes 53 and serve as general guides therefor. The major and minor axes of such camming lobe 53 are oriented 90° out of phase with those of its counterpart on the drive shaft 52. While one pair of tubular members 26 are being urged apart by a particular camming lobe having its major axis parallel to the rails 19, the other camming lobe has its minor axis parallel to the rails, leaving the opposite pair of tubular members oriented vertically. A biasing spring 54 exerting force through dual receptacles 55 joins together the lower ends of the tubular members 26. The biasing springs 54 are positioned vertically below the camming lobes 53 and travel parallel to the rails 19. Note that the pivot arms 48 also pass fore and aft of the biasing springs 54, so the camming lobes 53 and the springs 54 act on the inner faces of the tubular members 26 in the region between the pivot arms 48.

When the hydraulic motor 51 rotates the drive shaft 52, the camming lobes 53 urge apart the tubular members 26. The pivot arms 48 move about the pivot shaft 46 and compress the biasing spring 54. The lower ends of the tubular members 26 and the feet 27 affixed thereto move inward. As rotation of the camming lobes 53 continues, the upper ends of the tubular members 26 begin to move toward one another, returning to their original vertical positions. The biasing spring 54 urges apart the lower ends of the tubular members 26 and their associated feet 27. The motor 51 preferentially has an operating range that permits it to induce vibration of between 20–50 hz in the tubular members 26 and feet 27.

Figure 2:
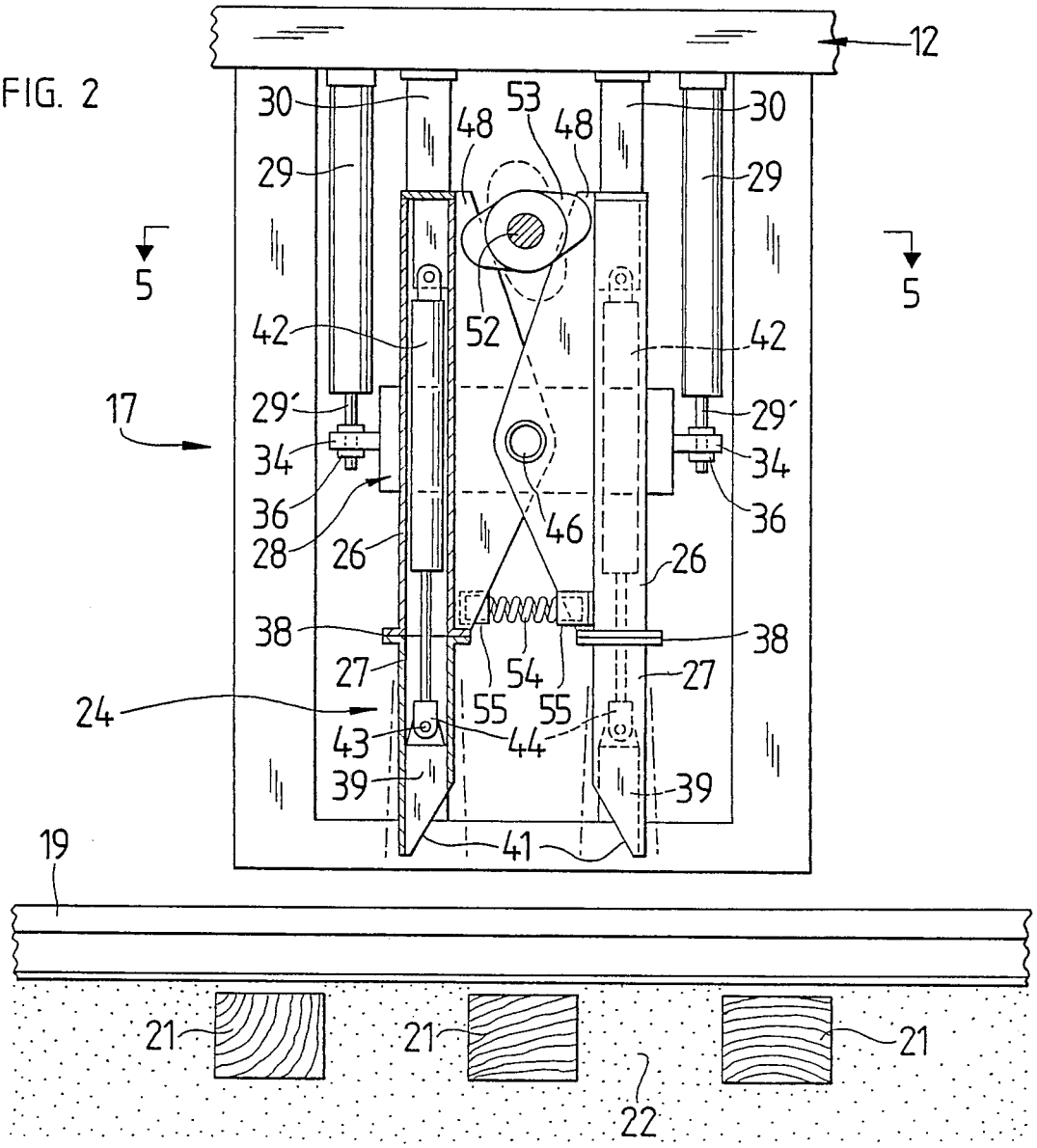
FIG. 2 is a detailed elevational view, looking outwardly toward the track shoulder, of a portion of the machine shown in FIG. 1, showing the basic structure of my apparatus in a non-operational (travel) position with some parts in section.
Figure 3:
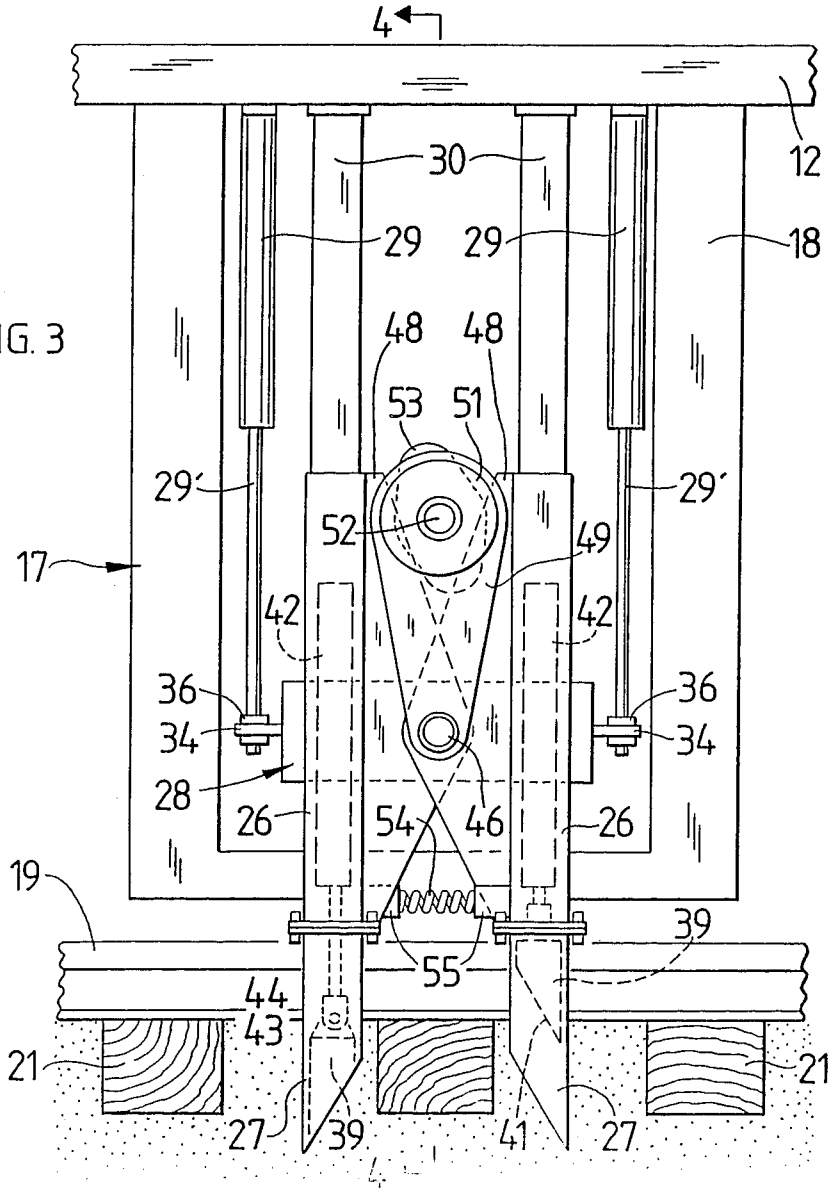
FIG. 3 is an elevational view, looking inward from the track shoulder, showing my apparatus in an operative position.

In operation, the apparatus is transported on the railroad track to the worksite in a raised position (FIG. 2). Once positioned, the hydraulic motors 51 commence operation, while at the same time the lift cylinders 29 are extended to urge the tamper assembly 24 downward. The feet 27, with the plungers 39 fully retracted, are urged into the newly placed ballast 22, thus capturing a portion of the ballast 22 therewithin (FIG. 3). The horizontal motion of the tamper assembly transmits vibration into the ballast 22.

The track raising mechanism 16, as is conventional, lifts the track to its proper elevation. At this time the plungers 39 are forced downward by cylinder 42 and the trapped ballast is forced out of the open end of the foot 27. Since the ballast is vibrating it is somewhat fluid-like, thus the pressure exerted by the ballast exiting the foot 27 is transferred to the adjacent ballast. Since the foot 27 opens inwardly and downwardly and since the plunger 39 is shaped in the same manner, the downward pressure of the cylinder 42 is converted into a composite force having an associated lateral component which urges the adjacent ballast firmly beneath the cross tie 21. The inward and outward motions of the tubular members 26 and their associated feet 27 also urge the ballast beneath the cross ties. In effect the ballast is urged from the area within the tamper foot 27 toward the area beneath the tie. Thus the volume of the tamper foot determines the amount of effective tamping which can be accomplished using my apparatus. As may be seen from the drawings the feet 27 are rectangular tubes extending longitudinally parallel to the ties and vertically to above the ties, thus a substantial amount of ballast can be displaced from within the feet into the volume underlying the ties.

When the plungers 39 meet maximum penetration, that is, when all of the ballast has been forced out of the feet 27, the horizontal vibratory motion is stopped and the tamper assembly 24 is raised and lowered with the plungers 39 in their extended position to compact the crib material. Thus it may be seen that this single apparatus is capable of combining tamping and compaction in a single efficient operation, thereby providing optimum consolidation of the ballast section.

While I have shown my invention in one form, it will be obvious to those skilled in the art that it is not so limited but is susceptible of various changes and modifications without departing from the spirit thereof.

What I claim is:

1. Apparatus for compacting ballast beneath railroad ties while supported on a carriage resting on said railroad ties comprising:

(a) a plurality of hollow tamping columns supported in pairs on said chassis for vertical movement relative to a railroad tie intermediate the tamping columns of each pair with each column being open at the lower end thereof;

(b) ram means mounted for vertical movement within each of said tamping columns for exerting downward force on said ballast; and (c) means for inducing forced oscillation in said columns.

2. Apparatus as described in claim 1 wherein each of said tamping columns has a triangular profile at the lower end thereof such that each tamping column in a pair has its lowermost point located outwardly from the other tamping column in a pair.

3. Apparatus as defined in claim 2 wherein said ram means includes an end portion having a right triangular profile along its lower extremity such that the downward force applied to said ballast thereby is resolved into a downward component and a lateral component directed beneath said railroad tie.

4. An apparatus as defined in claim 3 wherein said means for inducing forced oscillation comprises:

(a) a pivot shaft supported on said chassis (b) a rocker arm affixed to each of said tamping columns, said rocker arms articulating about said pivot shaft;

(c) a drivers camshaft having a number of elliptical lobes mounted thereon, said lobes acting directly on the tamping columns of each pair to displace said columns from a vertical resting position;

(d) a biasing spring acting to return the tamping columns of each displaced column pair to the vertical resting position.

5. An apparatus as defined in claim 4 wherein said tamping columns of each pair oscillate about said pivot shaft at a rate of between 30 and 50 hertz.

6. An apparatus as defined in claim 5 wherein the oscillations of the tamping columns of each pair are phase shifted 90° with respect to the oscillations of a neighboring pair of tamping columns.

7. An apparatus as defined in claim 3 wherein said means for inducing forced oscillation is a camshaft having a number of ellipltical lobes affixed thereto, said lobes acting directly on said columns to induce oscillation between 30 and 50 hertz therein.

8. Apparatus as defined in claim 2 wherein said tamping columns have replaceable foot portions with said foot portion opening downwardly and inwardly toward an adjacent tie.

9. Apparatus as defined in claim 1 wherein said ram means includes an end portion having a right triangular profile along its lower extremity such that the downward force applied to said ballast thereby is resolved into a downward component and a lateral component directed beneath said railroad tie.

10. Apparatus as defined in claim 1 wherein the lower portion of each tamping column is wedge-shaped having a portion inclined downwardly and away from the opposing tamping column in a pair.

11. Apparatus as defined in claim 10 wherein said ram means includes an end portion having a right triangular profile along its lower extremity such that the downward force applied to said ballast thereby is resolved into a downward component and a lateral component directed beneath said railroad tie.

12. Apparatus as defined in claim 1 further comprising means for raising and lowering said plurality of hollow tamping columns such that said columns may be supported above the track or inserted into the ballast.

13. A method for compacting ballast beneath a railroad tie comprising the steps of:

(a) distributing a bed of ballast about and beneath said tie with said bed of ballast having a predetermined depth;

(b) inserting hollow tamping columns into said ballast on both sides of said tie, such that a portion of said ballast is confined within said tamping columns;

(c) inducing vibration in said tamping columns and the ballast adjacent said columns beneath said tie;

(d) urging said ballast confined within said tamping column downwardly such that said ballast is urged toward an area beneath said tie;

(e) removing said tamping columns from said bed of ballast; and (f) repeating the preceding steps until the ballast in said bed is compacted.

14. The method as defined in claim 13 wherein said ballast is urged downwardly by a ram member moving vertically within said tamping column.

15. The method as defined in claim 13 wherein said induced vibrations are induced in a range from about 30 to about 50 hertz.

16. The method as defined in claim 15 wherein said ballast is urged downwardly by a ram member moving vertically within said tamping column.

* * * * *